US006468130B1

(12) United States Patent
Thakur et al.

(10) Patent No.: US 6,468,130 B1
(45) Date of Patent: Oct. 22, 2002

(54) UNDERWIRE FOR BRASSIERE

(75) Inventors: Ajit Thakur, Eagleville, PA (US); Joseph Horta, Yonkers, NY (US)

(73) Assignee: S&S Industries, Inc., Bronx, NY (US)

( * ) Notice: Subject to any disclaimer, the term of this patent is extended or adjusted under 35 U.S.C. 154(b) by 0 days.

(21) Appl. No.: 09/895,515

(22) Filed: Jun. 28, 2001

(51) Int. Cl.[7] ..... A41C 3/00
(52) U.S. Cl. ..... 450/41; 450/51
(58) Field of Search ..... 450/41, 42, 43, 450/45, 47, 48, 51, 52; 2/255, 256, 257, 258, 259, 260, 260.1, 261, 264, 263

(56) References Cited

U.S. PATENT DOCUMENTS

| | | | | | |
|---|---|---|---|---|---|
| 1,075,731 | A | * | 10/1913 | Schuler | 2/255 |
| 1,119,015 | A | * | 12/1914 | Hatch | 2/255 |
| 1,162,718 | A | * | 11/1915 | Dean | 2/255 |
| 1,276,700 | A | * | 8/1918 | Kleeman | 2/255 |
| 2,553,241 | A | | 5/1951 | Dache | 2/42 |
| 2,762,055 | A | * | 9/1956 | Bermueller | 450/41 |
| 2,830,300 | A | * | 4/1958 | Schwartz | 2/255 |
| 2,852,781 | A | * | 9/1958 | Ganser | 2/255 |
| 2,908,913 | A | * | 10/1959 | Sobel | 2/255 |
| 2,938,215 | A | * | 5/1960 | Schwartz | 2/255 |
| 3,020,557 | A | * | 2/1962 | Sobel | 2/255 |
| 3,114,374 | A | | 12/1963 | Chalfin et al. | 128/465 |
| 3,129,435 | A | * | 4/1964 | Spence | 2/255 |
| 3,702,614 | A | | 11/1972 | Miller | 12/476 |
| 3,777,763 | A | | 12/1973 | Schwartz | 128/476 |
| 3,799,175 | A | | 3/1974 | Rowell | 128/476 |
| 4,133,316 | A | * | 1/1979 | Schwartz | 2/255 |
| 6,106,363 | A | * | 8/2000 | Werner | 450/41 |

FOREIGN PATENT DOCUMENTS

| | | |
|---|---|---|
| DE | 26 31 136 | 7/1976 |
| EP | 1 053 692 A2 | 9/2000 |
| JP | 7090702 A | 4/1995 |

OTHER PUBLICATIONS

EPO Office Letter/Search Report Nov. 26, 2001.

* cited by examiner

*Primary Examiner*—Gloria M. Hale
(74) *Attorney, Agent, or Firm*—Abelman, Frayne & Schwab

(57) ABSTRACT

A supporting underwire for a brassiere or other undergarment is provided at one or both ends with a polymeric tip that is resiliently mounted for movement in the direction of the longitudinal axis of the underwire to lessen and/or extend the effective length of the underwire when it is in position in the undergarment.

30 Claims, 6 Drawing Sheets

FIG. 1
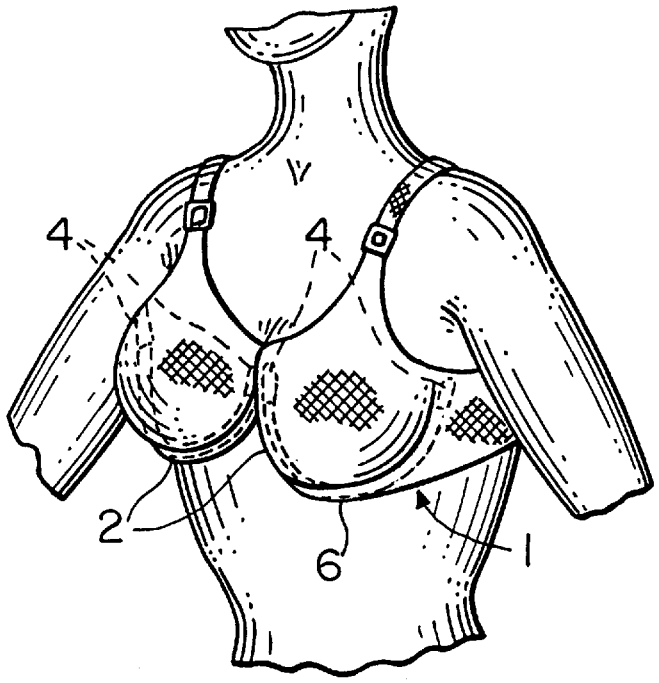
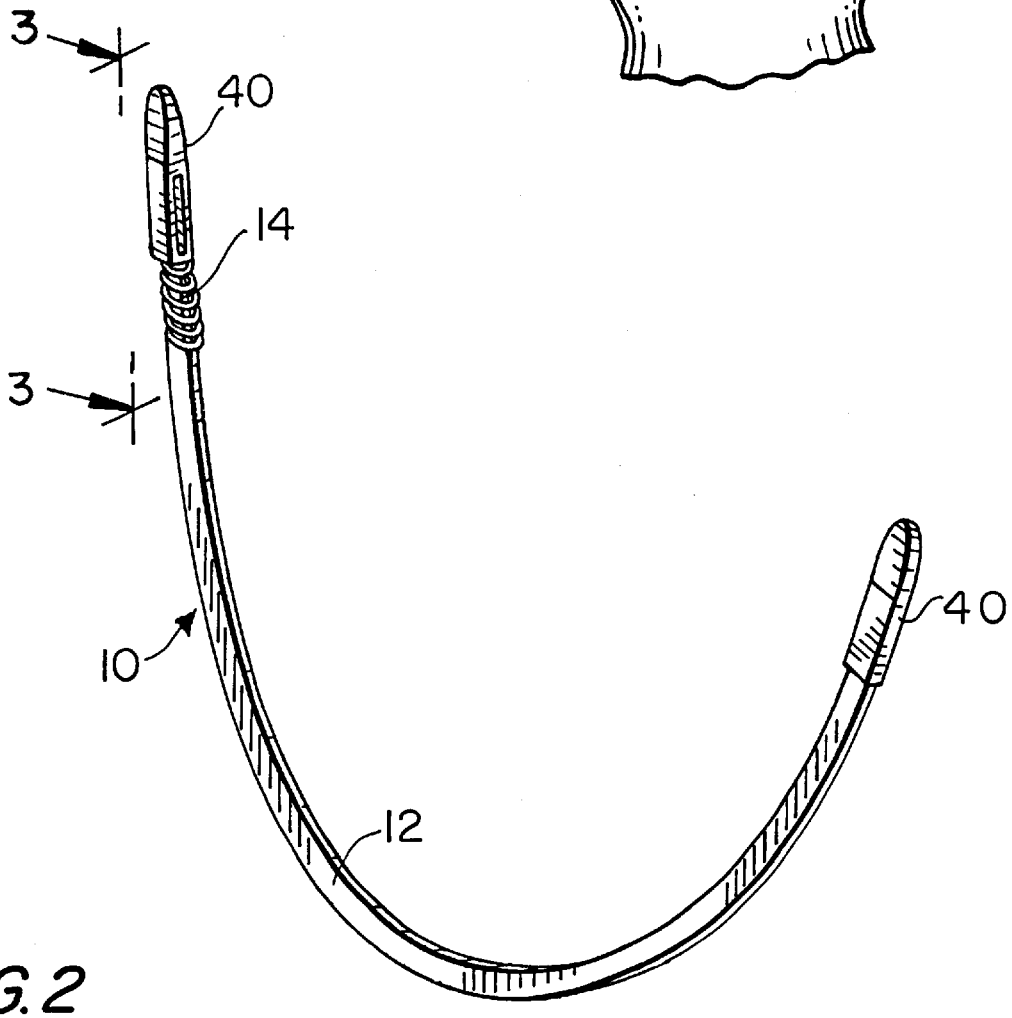
FIG. 2

FIG. 9
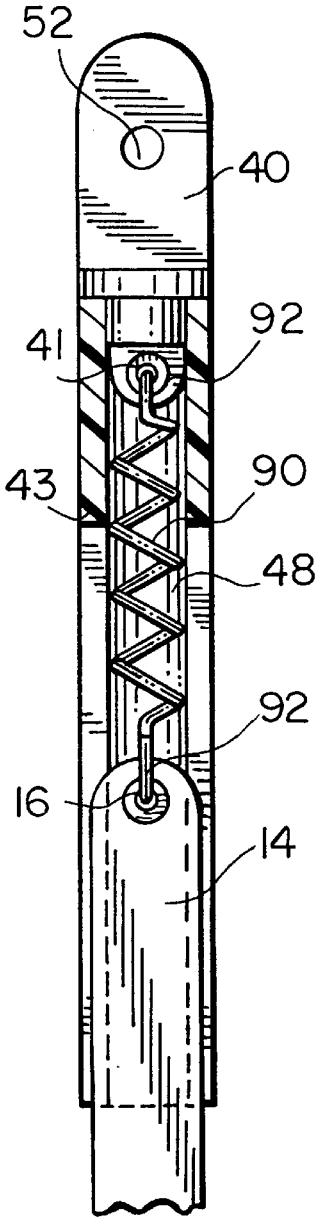
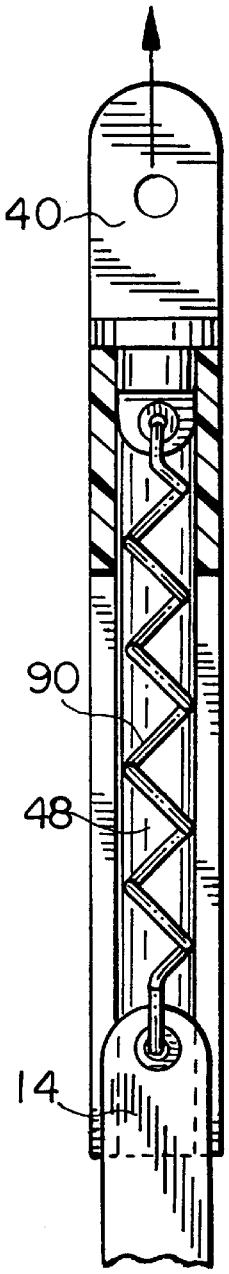
FIG. 10
FIG. 11
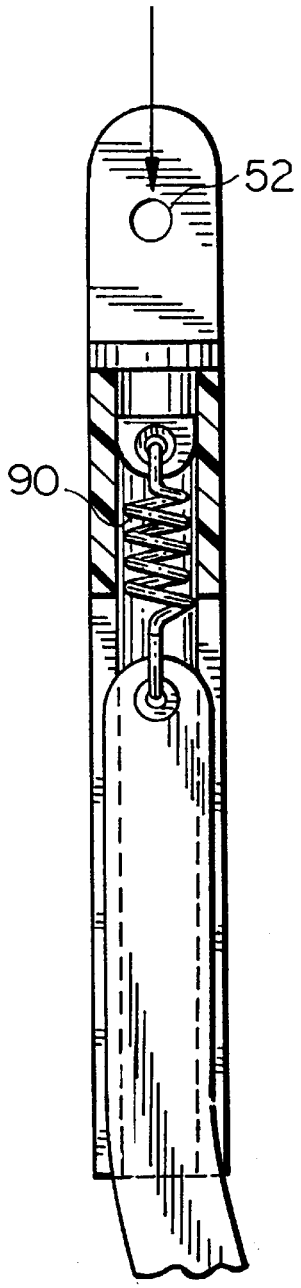

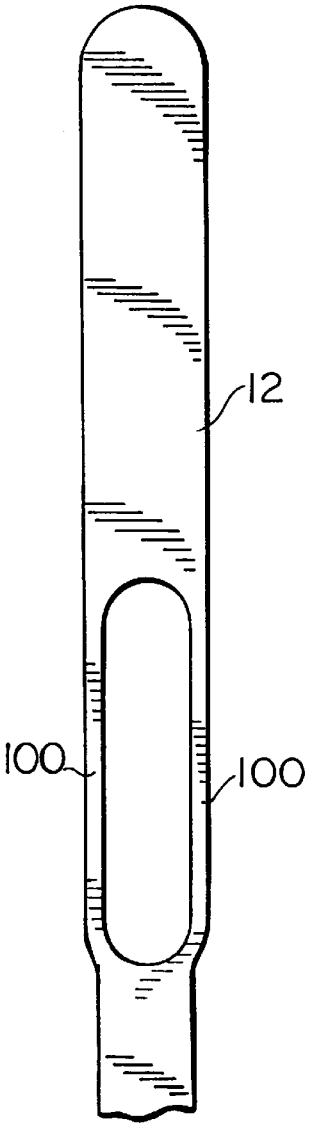
FIG.12
FIG. 13
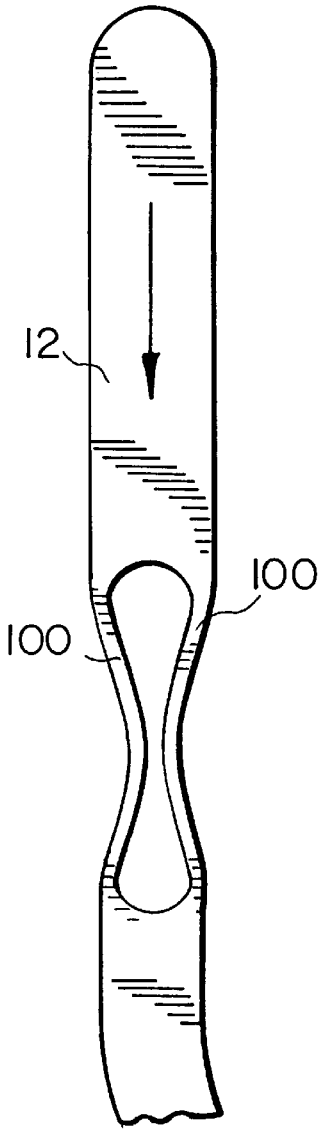
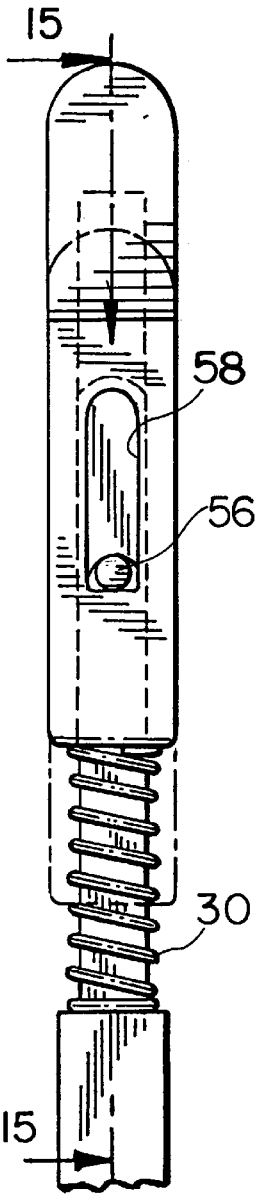
FIG.14
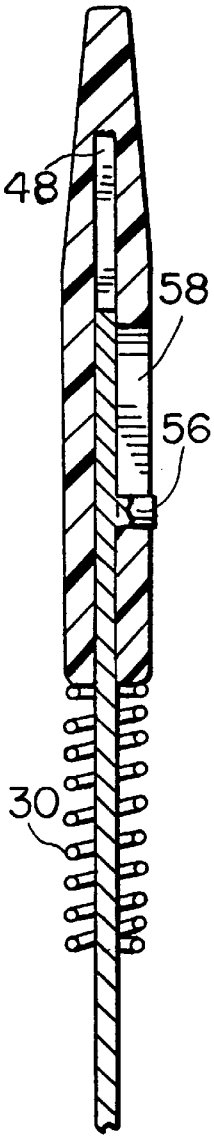
FIG.15

UNDERWIRE FOR BRASSIERE

FIELD OF THE INVENTION

This invention relates to underwires used in foundation garments such as brassieres.

BACKGROUND OF THE INVENTION

Underwires are employed to provide shape and support to brassieres, corsets and other similar foundation undergarments. They are typically rigid, flat steel members having a U-shaped configuration, or are formed from a hard, molded or extruded engineering plastic having some inherent shape and curvature.

Underwires used in the manufacture of brassieres and the like have been provided with a plastic or polymeric tip at either end. Examples of the construction and the assembly of underwires having such tips are disclosed in U.S. Pat. No. 4,133,316.

The underwire is maintained in a sleeve or casing that is formed below the breast cup of the brassiere and that is necessarily made from a soft woven or knitted fabric. In order to prevent one or both ends of the metal or polymeric underwire from penetrating the fabric casing and/or pressing uncomfortably through the garment into the wearer, it has long been the practice to provide the free ends of the underwire with a tip.

The polymeric tip can be in the form of a molten thermoplastic material into which the underwire is dipped and then removed and allowed to cool and harden into a generally spherical shape. Alternatively, the plastic material can be further shaped while in a pliable state in order to create contours that will easily pass through the retaining casing when it is assembled to the garment and that will fit comfortably against the wearer. An improved cushion tip in which a relatively soft and pliable polymeric material is molded directly on to the free end of the underwire is described in U.S. Pat. No. 5,830,040, the disclosure of which is incorporated herein by reference.

In a second embodiment known to the art, the tip is produced separately from a polymeric material and then fitted using appropriate retaining means to the end of the underwire. In a more recent advance in the art, the separate polymeric tips have been produced using a material that is more pliable and has the feel of an apparently "softer" terminus to the wearer of the garment.

Despite the advance in the art of providing a more pliable tip having a softer feel, problems are still known to exist. For example, when the wearer assumes certain positions in which the torso is turned and/or twisted, as in bending over to pick up something from a position to the wearer's right or left side, the tip of the underwire which lies beneath the arm tends to exert an extreme pressure against the end of the fabric casing. Depending upon the age, condition and type of fabric used in the casing, the tip can puncture the casing. This condition is not readily reparable and the garment may have to be discarded. In addition, the protruding tip may contact the wearer's flesh causing extreme discomfort.

Even if the tip of the underwire does not penetrate the casing, the turning and twisting and/or bending of the torso can still cause the tip of the underwire to press into the flesh beneath the wearer's arm and produce discomfort that spans the spectrum from merely uncomfortable to painful. Periodic physiological changes are also experienced by some women in association with their menstrual cycle, as well as during pregnancy, can results in discomfort at time.

Variations in body types and anatomical differences can also result in discomfort among some women even when the brassiere is of the "correct" size. some women also find that a particular style or design of brassiere is not as comfortable as others because the tip of the underwire produces an undesired pressure.

Yet an other recognized problem is a change that occurs when the garment is laundered, particularly with respect to shrinkage of the fabric pocket or tube that retains the underwire in place. Such shrinkage of the fabric of the casing and/or of the brassiere itself results in a continuous internal force applied by the underwire tip against the closed end of the casing and premature wear and failure of the casing. Once the underwire has broken through, the garment is deemed to be unwearable long before its otherwise useful life is reached.

It is therefore an object of the present invention to provide an improved tip assembly and construction for an underwire which is more responsive to pressures and forces that are applied during the physical activity of the wearer to thereby reduce or entirely avoid the application of excessive concentrated force to the casing containing the underwire and to the wearer.

It is also an object of the invention to provide an underwire having a resiliently mounted tip that is relatively inexpensive to manufacture and assemble and which is reliable in its mode of operation and rugged in construction.

Yet another object of the invention is to provide a resiliently mounted tip assembly and method of construction for an underwire that is adapted for use with both metal and polymeric underwires and that can be produced from a variety of materials in various shapes and sizes to accommodate the requirements of the trade.

SUMMARY OF THE INVENTION

The above objects and other advantages are realized in the improved underwire which comprehends the resilient mounting of a polymeric tip on at least one end of a garment-supporting underwire. In a first preferred embodiment, the tip is separately formed, i.e., by molding and/or machining the tip from a polymeric material having a composition commonly used for such purposes. The tip is resiliently mounted on a free end of the underwire for sliding movement within a predetermined range. The range of movement of the tip can be determined by the cooperative engagement of mounting means on the free end of the underwire with the tip.

In one aspect of this embodiment, a compression spring is mounted between a retaining shoulder formed on the underwire and the proximal end of the tip. When a force is applied to the distal end of the tip, the tip slides along the longitudinal axis of the underwire to compress the spring. When the force is removed or lessened, the spring urges the tip to return to its original position.

In another aspect of this embodiment, the tip is again mounted on the underwire in longitudinal sliding relation. A spring which can act in both extension and compression is affixed at one of its ends to a point of attachment on the free end of the underwire and at its opposite end to a point of attachment on the slidable tip. As in the earlier-described embodiment, when a longitudinal force vector is applied to the distal end of the tip, the tip moves along the underwire and is opposed by the resisting force of the spring in compression. When the compressive force is removed or lessened, the tip returns to its original position.

In this second aspect of the invention, it is contemplated that the distal end of the tip is sewn or otherwise secured in position at the end of the casing. Thus, when the wearer's motion is such that the opposite end and/or intermediate portion of the underwire is subjected to a force in the opposite direction, i.e., away from the secured resiliently-mounted tip, the retaining spring expands until such force is reduced or discontinued, after which the extended spring returns to its neutral position and brings with it the underwire. This construction has the advantage of eliminating movement of the tip within the casing, which can lead to excessive wear of the fabric casing in the vicinity of the tip and to premature failure of the casing.

The invention also comprehends an underwire in which at least one, but preferably a plurality of resilient elements are included in, and form an integral part of the underwire. The one or more resilient members can be displaced from the point of attachment of the tips, for example, at three spaced apart locations. The one or more resilient members can take the form of coiled metal expansion and/or compression springs the ends of which are molded into and retained by the adjacent sections of the underwire, e.g., a molded plastic composition of a type known to the prior art. Alternatively, a metal spring can be incorporated by welding to a section of a metal underwire. In yet another alternative construction, the one or more resilient members are formed integrally with the underwire, as by molding of an underwire formed of plastic.

In this latter embodiment, the underwire is produced with at least one resilient portion that is integrally formed, e.g., by molding, stamping and/or machining processes known to the art. In a particularly preferred aspect of this embodiment, the underwire is produced from a polymeric material and is provided with a plurality of generally V-shaped elements which are joined to form a portion having a zig-zag or accordion configuration. This configuration responds to compressive and extensive forces applied longitudinally to the underwire providing a resistance and reflexive force that is analogous to that of a spring. This resilient portion of the underwire is preferably positioned adjacent a free end which is configured to receive a separate tip in fixed relation. Alternatively, the tip can be integrally molded with the underwire body. When a compressive force is applied to the distal end of the tip, the integral resilient portion of the underwire is compressed proportionately. Just as a steel spring has an associated spring constant value, a similar or comparable value can analogously be calculated for various configurations of the zig-zag elements forming the integral resilient portion of the underwire. Other alternative and preferred configurations of flexible longitudinal elements integrally formed in the underwire are described in more detail below.

The range of movement of the tip with respect to the underwire is not critcal. The travel of the tip can be from about 0.12 to about 0.5 inches, or from about 2 mm to about 13 mm. The range can be varied based upon the size and type or style of the garment; whether one or both ends of the underwire are provided with resiliently mounted tips, and other factors that will be apparent to one of ordinary skill in the art.

The tip is preferably formed from a polymeric material that has sufficient resiliency to deflect when subjected to a lateral force and return to its original form. The polymer selected should have sufficient elasticity to permit the tip to be passed over a contoured retaining flange or pin formed on the free end of the underwire and then return to its original configuration. The polymeric material chosen for the tip also must have sufficient tensile strength to resist deformation at its points of attachment to the underwire and the end of the spring in the embodiment described above. Suitable polymers can be selected from the class of thermoplastic polyoletin elastomers. Products sold in the United States by DuPont Dow under the trademark ENGAGE®, 8401 and 8402, can be utilized.

The underwire can be fabricated from stainless steel, or steel that has been galvanized or otherwise coated. Aluminum and aluminum alloys, copper and copper alloys, steel alloys, and other types of metal can be used without limitation.

As is also known to the art, the underwire can be fabricated from various polymeric materials and engineering plastics. Suitable polymers, copolymers and blends used for molding, extruding and machining of underwires can include nylon, polyethylene, butadiene/styrene, acrylonitile/butadiene/styrene, polycarbonates, polyvinyl chlonde, and others. Desired physical properties can be provided and enhanced by reinforcing the polymers by addition of glass and carbon fibers to the liquid resins. Polymeirc or plastic underwire bodies can be of any cross-sectional configuration and dimension that is known to be useful in the art, and such features are not critical to the method or apparatus of the invention.

In all of these embodiments, including those last described above, the overall length of the underwire is reduced in response to a compressive force resulting from any of a change in the wearer's position, the wearer's anatomy, shrinkage of the garment, or the application of an excessive strain during mechanical washing. Thus, the above objects are achieved and other advantages are realized by the construction and operation of the improved underwire of the invention.

BRIEF DESCRIPTION OF THE DRAWINGS

The invention will be further described below with reference to the attached drawings, wherein like elements are referred to by the same number, and in which:

FIG. 1 is a front left perspective view of a brassiere on a model illustrating the relative position of the supporting underwires in the garment and to the wearer's torso;

FIG. 2 is a top left perspective view of one embodiment of an underwire suitable for use in supporting the cup illustrated on the left side of FIG. 1;

FIG. 9 is a front elevation view, partly in section, schematically illustrating a portion of the free end of underwire with a spring-mounted tip;

FIG. 10 is a view similar to FIG. 9, showing the effect of an extensive force applied to the tip;

FIG. 11 is a view similar to FIG. 9, showing the effect of a compressive force applied to the tip;

FIG. 12 is a front elevation view of a further embodiment of the invention showing a tip integrally formed in the end of the underwire and incorporating an intermediate flexible section;

FIG. 13 is a view similar to FIG. 12 showing the effect ont he resilient section of a compressive force applied to the tip;

FIG. 14 is a front elevation view of another embodiment of the invention showing a separate tip spring-mounted on the free end of the underwire, the effect of a compressive force applied to the tip being shown in phantom; and FIG. 15 is a side elevation view in section of the embodiment of FIG. 14, taken along line 15—15.

DESCRIPTION OF PREFERRED EMBODIMENTS

Figure 3:
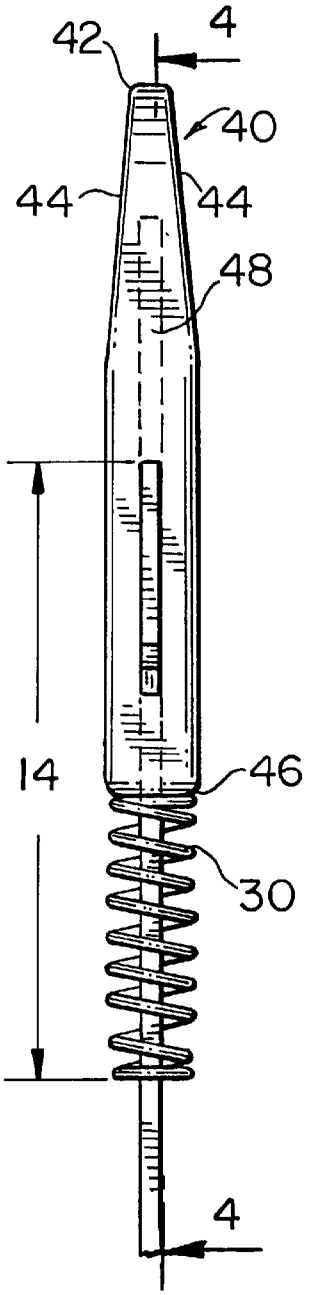
FIG. 3 is a side elevation view of the resiliently mounted tip and a portion of the underwire taken along section line 3—3 in FIG. 2.

For the purposes of providing a clear understanding of the principles of the invention, reference will be made to the embodiments illustrated in the drawings and a detailed description of each will be provided. It will, nevertheless, be understood that no limitation of the scope of the invention is thereby intended, such alterations and further modifications in the illustrated devices, and such further applications of the principles of the invention as illustrated therein being contemplated as would normally occur to one skilled in the art to which the invention relates.

With reference to FIG. 1, there is illustrated a brassiere constructed in accordance with the prior art showing the relative position of a pair of separate underwires 2 with tips 4 rigid affixed to each of the free ends of the underwire. The underwires are positioned inside of fabric casings that are sewn into the garment.

Referring now to FIG. 2, there is shown an underwire assembly 10 in accordance with the present invention formed from a flat steel strip 12, preferably a stainless steel or a galvanized or otherwise coated steel that will be resistant to rust and corrosion. As shown, the underwire 10 is arcuate in form, its contour corresponding to that of the casing affixed to the periphery of the brassiere cup into which the underwire will be inserted to provide shape.

Figure 4:
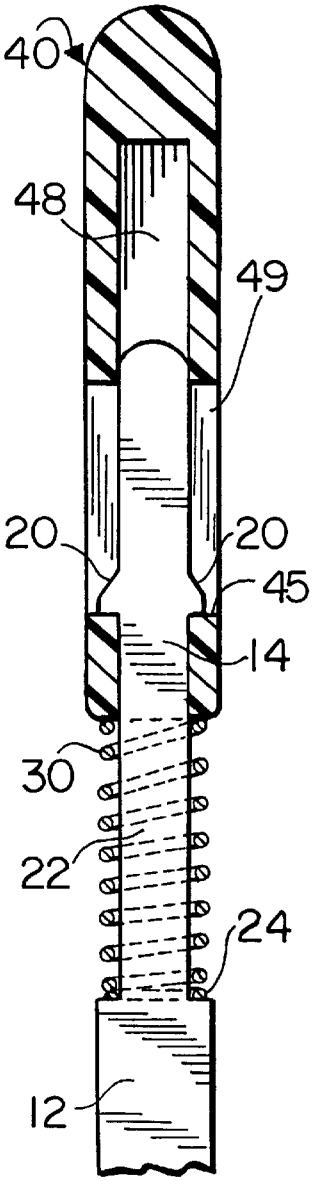
FIG. 4 is a front elevation view, partly in section, taken along section line 4—4.
Figure 5:
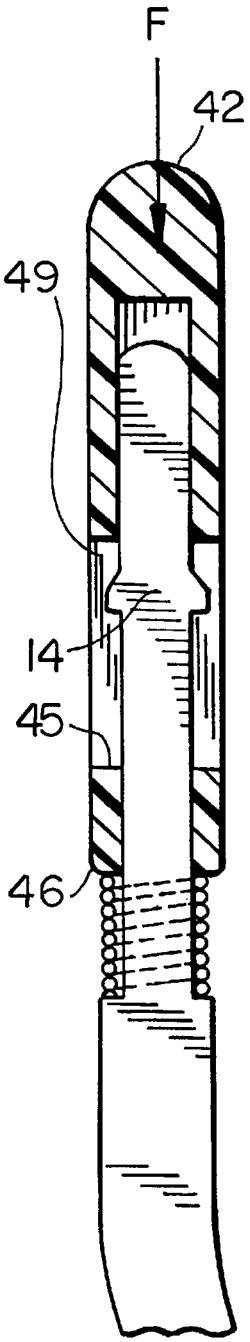
FIG. 5 is a view similar to FIG. 4 showing the effect of a compressive force applied to the free end of the tip.

As best shown in FIGS. 3–5, at least one free end 14 of the underwire 12 is configured to receive and retain a tip 40 that is mounted in sliding relation in accordance with the method and apparatus of the invention. In the embodiment illustrated, a pair of tapered retaining flanges 20 project transversely in the longitudinal plane of the underwire 12. Each of the retaining flanges extend outwardly from the distal portion of the free end of the underwire to terminate at a retaining edge which is generally normal to the longitudinal axis of the underwire. Spring retaining shoulder 24 is formed adjacent narrowed portion 22 extending from the wider end of underwire 12. In this embodiment, the narrowed portion 22 is adapted to receive a coil compression spring 30, as best shown in FIG. 4. The longitudinal distance between flange 20 and spring retaining shoulder 24, less the height of the compressed spring 30, determines the longitudinal distance which the tip can move in response to a force that is applied to its distal end 42.

With further reference to FIGS. 2 through 5, the tip 40 is formed with gently rounded distal end 42 and contoured with outwardly tapering top and bottom surfaces 44 terminating in proximal end 46. Since the tip is to be inserted for movement through, and in, a soft fabric casing, all corners and edges are preferably rounded and smoothed to prevent snagging or tearing and fraying of the adjacent fabric. The maximum width or transverse dimension of the tip 40 can be approximately that of the flat metal underwire 12. The thickness of the tip is sufficient to receive the free end of the underwire 12 in close-fitting sliding relation, while providing sufficient surrounding material to avoid cracking or deformation of the tip during assembly to the underwire and to insure that the tip maintains its form and integrity during wear and cleaning.

Figure 6:
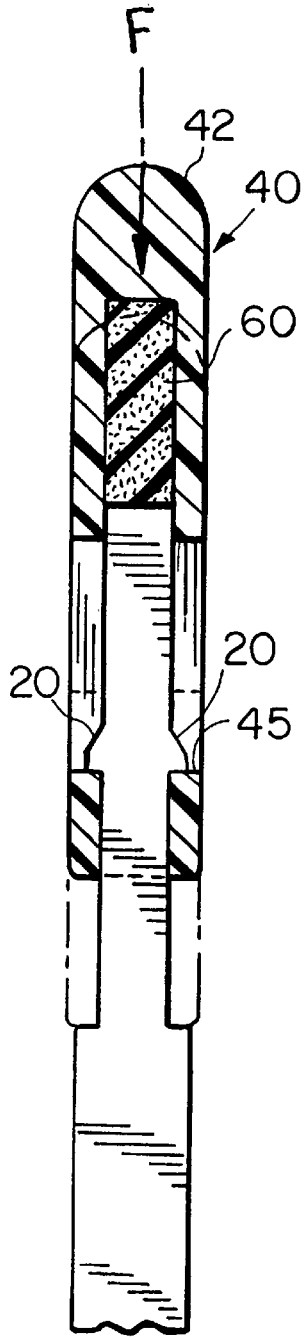
FIG. 6 is a view similar to FIG. 5 illustrating another embodiment of the invention employing a compressible foam element, the effect of a compressive force being shown in phantom.

With reference to FIG. 6, a further embodiment of the invention is shown in which the resilient member takes the form of a compressible polymeric foam that is positioned in the distal end of channel 48 of tip 40. When a force F is applied to the distal end 42 of the tip, the distal surface of free end 14 contacts and compresses the foam thereby reducing the overall length of the underwire assembly 10.

Figure 7:
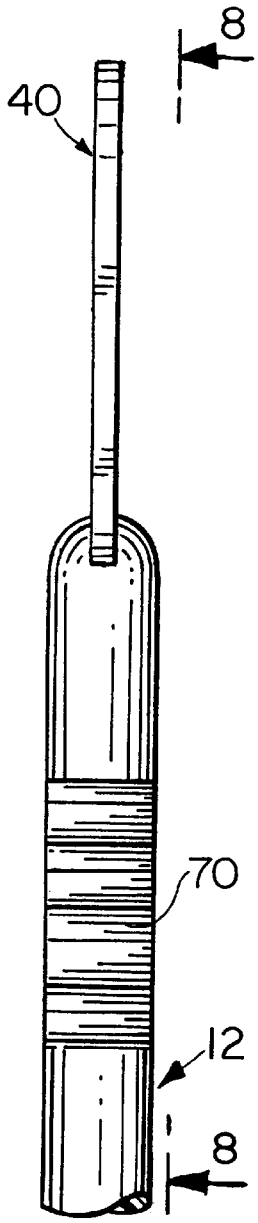
FIG. 7 is a side elevation view of a tip and a portion of the free end of the underwire illustrating another embodiment incorporating an integral resilient member on the underwire.
Figure 8:
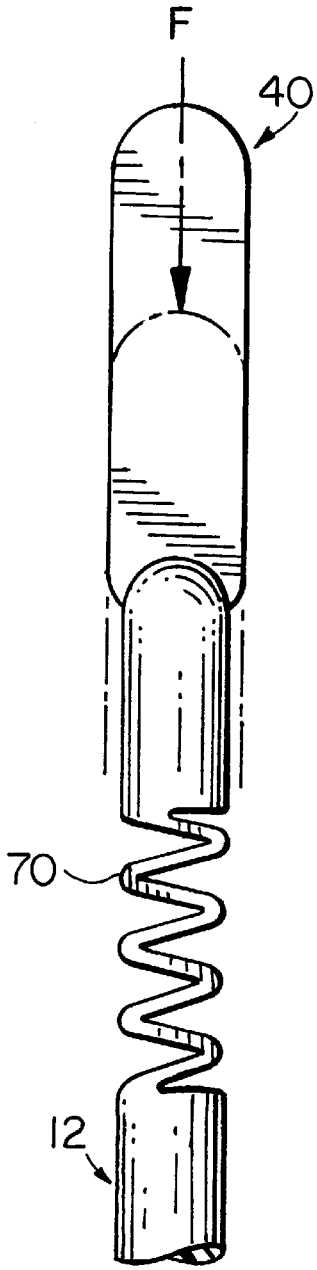
FIG. 8 is a front elevation view of the tip and underwire of FIG. 7, taken along line 8—8, the effect of a compressive force being shown in phantom.

As shown in the further preferred embodiment of FIGS. 7 and 8, the underwire body 12 is provided with integrally formed resilient members in the nature of a series of contiguous V-shaped elements 70 that extend for a predetermined longitudinal length and, in the embodiment shown, extend transversely across the full width of the underwire body. This zig-zag or accordion-like section can be formed at the time of manufacture of the underwire, as by molding. Alternatively, this type of resilient member can be formed by machining a previously produced underwire body 12. As will be apparent to one of ordinary skill in the art, the relative flexibility and a corresponding desired equivalent spring constant value can be achieved by a variety of means. Such variables include the composition of the polymer employed; the thickness and configuration of the zig-zag elements, as well as the precise configuration of the regions at which they are joined; the thickness of the material; the length and number of the section(s) comprising the resilient member; and the like.

As will be understood from the above description of the various embodiments, the resilient member 25, whether it be in the form of a spring formed of coiled wire or formed from the same material and integral with the underwire body 12, can be of a compression type or of a compression-expansion type. In the case of a compression spring, the overall length of the underwire assembly 10 can be reduced in response to a force applied to one or both tips. In the case in which a compression-expansion spring is employed, the length can be both decreased and increased in response to the corresponding forces on the garment casing and/or tips of the underwire.

Referring now to FIGS. 9 through 11, there is illustrated a further preferred embodiment where the tip 40 is joined to the free end 14 by a spring 90 that acts both in compression and expansion. FIG. 9 shows the assembly in a neutral position with the free ends 92 of spring 90 secured in aperture 16 in free end 14 and in aperture 41 of tip 40. As illustrated in each of the cross-sectional views, the spring is positioned in channel 48 that extends axially through skirt 43 depending from the distal end 42 of tip 40. In this embodiment, tip 40 is provided with a retaining aperture 52 to permit it to be secured, as by stitching, to the casing and/or underlying body of the garment to prevent it from moving once it has been properly positioned in the casing. Alternatively, tip 40 can be produced from a polymeric material that is sufficiently soft to permit the penetration of a sewing machine needle without providing aperture 52 for that purpose.

As shown in FIG. 10 when a force is applied tending to separate the tip from the underwire body, spring 90 expands, thereby providing an effective elongation of the underwire assembly 10. When the force is diminished or eliminated, the spring 90 returns tip 40 to its original neutral position, i.e., as in FIG. 9. As shown in FIG. 11, when a compressive force is applied, the spring 90 is compressed, the effective length of the underwire assembly 10 is reduced and the skirt 40 slides down the underwire. Upon dimunition of the compressive force, the spring expands to the neutral position and returns the tip to its original position.

A further embodiment will be described with reference to FIGS. 12 and 13, in which the resilient member is comprised of a plurality of elongated elements 100 formed in the underwire body 12. Although not shown for reasons of clarity and simplicity, it will be understood that a separate tip can be fitted to the free end 14. As illustrated in FIG. 13, when a compressive force is applied to the distal end of the underwire, the elements 50 are configured to flex and assume a curvilinear configuration, thereby reducing the effective length of the section in which the resilient member is formed. When the compressive force is reduced or eliminated, the longitudinal elements 100 will straighten to assume their original configuration and effective length.

For purposes of illustration and convenience, a pair of flexible elements 100 is shown in FIGS. 12 and 13; however, as will be apparent to one of ordinary skill in the mechanical arts a greater or fewer number of such elements can be incorporated in order to achieve a desired effective reduction in length in response to anticipated forces. The considerations of design to be applied are that the polymeric material can withstand a sufficient number of flexings and has sufficient recovery properties to return the tip to its desired positional location within the casing. The longitudinal elements 100 can be curved, weakened in one area, or otherwise configured to be predisposed to assume a particular oriental when a compressive force is applied.

A further preferred embodiment of the invention is shown in FIGS. 14 and 15. As in the embodiment of FIGS. 3–5, a compression spring 30 is mounted on a narrowed portion of the free end 14 of underwire body 12. Tip 40 is secured for longitudinally sliding movement by a retaining pin 56 which in a preferred embodiment is integrally formed in the free end 14. Tip 40 is provided with a retaining slot 58 that corresponds in length to the range of movement of the distal end of the tip. As will be understood from the illustration, the length of slot 58 can correspond to the difference in length of the compression spring 30 in its neutral position and its fully compressed position.

Figure 16:
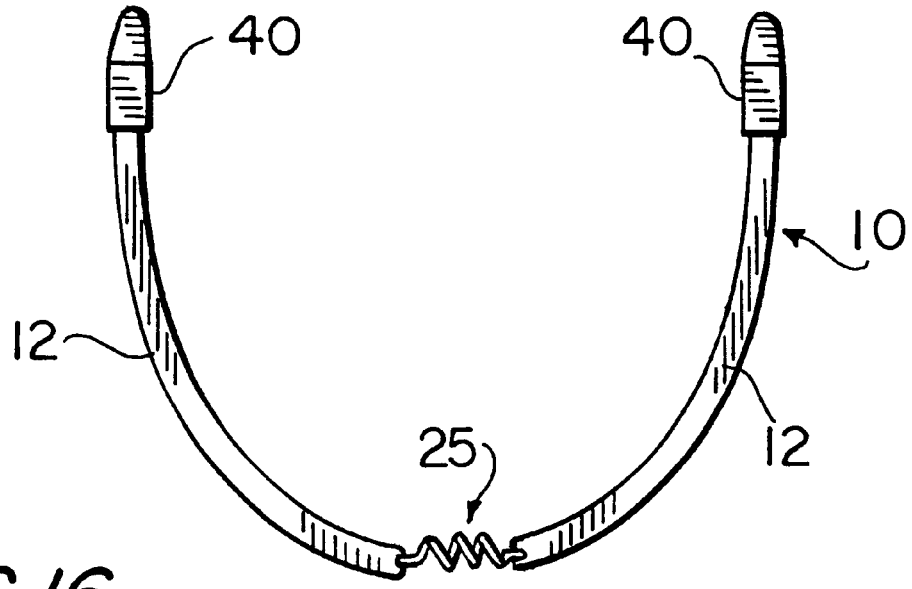
FIG. 16 is a front elevation view of another preferred embodiment of the invention that includes a resilient member in the underwire at a location displaced from the tips.
Figure 17:
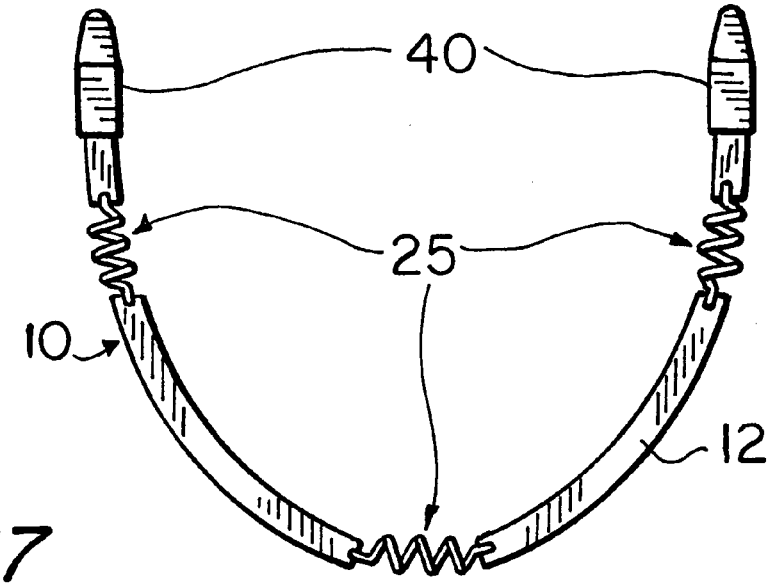
FIG. 17 is a front elevation view similar to FIG. 16 of a further preferred embodiment in which the underwire includes a plurality of resilient members.

With reference to FIGS. 16 and 17, two further embodiments are schematically illustrated in which one or more resilient members are incorporated into the underwire body 12 at positions longitudinally displaced from the tips 40. The resilient members, referred to generally as 25, can be of the type and configuration described in connection with FIGS. 7 and 8, above, or can take the form of steel coil springs. In the case in which steel springs are employed, the free ends of each spring are secured to the adjacent portion of the underwire body 12. In the case of a polymeric underwire body 12, the springs can be incorporated advantageously in the initial fabrication of the assembly, as by molding; the springs can be welded to metal underwire body sections to form a unitary assembly. In either case, the resilient member or members form an integral construction with the adjacent underwire sections, and possess sufficient strength and rigidity to be passed through the fabric casing during assembly of the garment and to withstand wear and repeated laundering.

It will also be understood that in the embodiment illustrated by FIGS. 14 and 15 that the assembly does not require either end of the spring to be secured to either the underwire body 12 or the tip 40, thus simplifying and making this construction relatively less expensive. In order to complete the assembly, the tip 40 is fabricated from a polymeric material that is capable of being deformed sufficiently to allow the retaining pin 56 to pass through the interior axial channel 48 by expanding the cross-sectional configuration of the channel, and thereafter returning to its original cross-section when the pin 56 is received in exterior slide slot 58. This means of assembly will be known to those of ordinary skill in the art as having been used with fixed tips on the free end of the underwire.

We claim:

1. An underwire assembly for use in a brassiere comprising:

a generally U-shaped arcuate member having opposed free ends, the length of the arcuate member being measured along the longitudinal axis of the arcuate member;

a resiliently-mounted cushion tip joined to at least one of the ends of the arcuate member by a resilient member, the cushion tip being movable in the direction of the longitudinal axis of the arcuate member, whereby the length of the underwire assembly is variable in response to an axial force component applied to the cushion tip.

2. The underwire assembly of claim 1 in which the cushion tip includes an interior channel for receiving the end of the arcuate member, said channel housing the resilient member that is joined to the cushion tip and to a terminal portion of the arcuate member.

3. The underwire assembly of claim 2 in which the resilient member is selected from the group consisting of compression springs and compression-expansion springs.

4. An underwire assembly for use as a brassiere support comprising:

a generally U-shaped arcuate member having opposed ends, at least one of said ends having a cushion tip mounted thereon, the cushion tip being slidably mounted for movement co-axially along the longitudinal axis of the arcuate member, and resilient mounting means secured to said cushion tip, and to said arcuate member, whereby said cushion tip is longitudinally movable in response to a force applied longitudinally to the tip.

5. The underwire assembly of claim 4 in which the resilient mounting means comprises a spring.

6. The improved underwire assembly of claim 5 wherein the spring is a compression spring.

7. The underwire assembly of claim 5 in which the spring is securely mounted on a terminal portion of the end of the arcuate member.

8. The underwire assembly of claim 4 in which the cushion tip is formed with an interior channel for receiving an end portion of the arcuate member, said channel extending from the exterior of a proximal end of the tip toward a distal end of the tip, said interior channel provided with a wider portion terminating in a shoulder at its proximal end, said end of the arcuate member including a tapered flange portion, said shoulder of the tip engaging the flange of the arcuate member to secure the tip on the end portion of the arcuate member.

9. The underwire assembly of claim 8 in which the resilient mounting means is selected from the group consisting of compression springs and compression-expansion springs.

10. An underwire assembly for use as a brassiere support comprising:

a generally arcuate U-shaped member having opposing ends, at least one of the ends terminated by a separate cushion tip secured to said end, the arcuate member formed with at least one integral resilient member along its longitudinal axis.

11. The underwire assembly of claim 10 in which the at least one resilient member is compressible and extensible.

12. The underwire assembly of claim 10 in which the at least one resilient member is secured to the cushion tip.

13. The underwire assembly of claim 12 in which the at least one resilient member is a steel compression spring.

14. The underwire assembly of claim 10 in which the at least one resilient member is longitudinally spaced intermediate the opposing ends of the arcuate member.

15. The underwire assembly of claim 14 that includes three resilient members.

16. The underwire assembly of claim 12 in which the arcuate member has a cushion tip at both free ends, each of said tips being secured to a resilient member.

17. The underwire assembly of claim 10, wherein the underwire is formed from material selected from the group consisting of metal and polymers.

18. The underwire assembly of claim 17, wherein the arcuate member is formed from a polymeric material and the at least one resilient member is a metal spring.

19. The underwire assembly of claim 17 in which the arcuate member and the at least one resilient member is formed from a polymeric material.

20. The underwire assembly of claim 19 in which the at least one resilient member is compressible and extensible.

21. The underwire assembly of claim 20 in which the at least one resilient member is of a zig-zag configuration.

22. The underwire assembly of claim 19 in which the at least one resilient member is comprised of a plurality of laterally spaced longitudinally-extending sections.

23. The underwire assembly of claim 10 in which the resilient member is a steel spring, a free end of which spring is received in a transverse opening in said cushion tip.

24. The underwire assembly of claim 14 in which the cushion tip is a soft pliable polymeric material and the tip is secured to the free end of the arcuate member while the polymeric material is in a molten state.

25. An underwire assembly for providing shape and support to a brassiere or similar foundation garment, the underwire assembly being compressible and/or extensible in length as measured along its longitudinal axis comprising:

a generally U-shaped arcuate member having opposed ends;

a cushion tip joined to one or both ends of the arcuate member; and at least one compressible resilient member having a longitudinal axis that is coincident with the longitudinal axis of the arcuate member, whereby the effective length of the underwire assembly is variable in response to a longitudinal force applied to the assembly.

26. The underwire assembly of claim 25 in which the resilient member is integral with, and formed of the same material as the arcuate member.

27. The underwire assembly of claim 25 in which the resilient member is secured to the cushion tip.

28. The underwire assembly of claim 27 in which the resilient member is integral with, and formed of the same material as the arcuate member.

29. An underwire assembly for use as a brassiere support comprising:

a generally U-shaped arcuate member having opposed ends, at least of said ends including a tapered flange portion, a cushion tip slidably mounted on the at least one end of the arcuate member, the cushion tip formed with an interior channel extending from the exterior of a proximal end of the tip toward a distal end of the tip, said interior channel provided with a wider portion terminating in a shoulder at its proximal end, said shoulder engaging the flange of the arcuate member to thereby maintain the tip on the end portion of the arcuate member, a resilient member positioned in the tip channel above the end of the arcuate member, the resilient member formed from a compressible polymeric foam.

30. The underwire assembly of claim 29, wherein the polymeric foam is a closed cell foam.

* * * * *